US005218351A

United States Patent [19]

Hashikawa

[11] Patent Number: 5,218,351

[45] Date of Patent: Jun. 8, 1993

[54] ELECTRICALLY CONDUCTIVE TRANSPARENT MATERIAL AND DISPLAY DEVICE USING THE ELECTRICALLY CONDUCTIVE TRANSPARENT MATERIAL

[75] Inventor: Takaaki Hashikawa, Tokyo, Japan

[73] Assignee: Sekisui Kagaku Kogyo Kabushiki Kaisha, Osaka, Japan

[21] Appl. No.: 705,051

[22] Filed: May 23, 1991

Related U.S. Application Data

[62] Division of Ser. No. 261,968, Nov. 14, 1988, abandoned.

[30] Foreign Application Priority Data

Jan. 12, 1987 [JP] Japan ..... 62-5585
Sep. 12, 1987 [JP] Japan ..... 62-228947

[51] Int. Cl.[5] ..... G09G 3/20; D04H 1/00

[52] U.S. Cl. ..... 340/752; 428/294; 428/295; 340/766; 340/756

[58] Field of Search ..... 340/784, 705, 781, 752, 340/766, 756; 313/502, 500; 362/800; 428/294, 295; 156/171, 291

[56] References Cited

U.S. PATENT DOCUMENTS

| | | | |
|---|---|---|---|
| 3,023,394 | 2/1962 | Hubbell . | |
| 4,134,104 | 1/1979 | Karras | 340/780 |
| 4,386,333 | 5/1983 | Dillan | 336/107 |
| 4,578,628 | 3/1986 | Siwiak | 320/2 |
| 4,772,226 | 9/1988 | Schlesinger | 439/680 |
| 5,100,490 | 3/1992 | Holroyed et al. | 428/295 |

FOREIGN PATENT DOCUMENTS

| | | | |
|---|---|---|---|
| 0109852A3 | 11/1983 | European Pat. Off. . | |
| 393059 | 10/1908 | France . | |
| 0049189 | 12/1979 | Japan | 362/800 |

*Primary Examiner*—Alvin E. Oberley
*Assistant Examiner*—Amare Mengistu
*Attorney, Agent, or Firm*—Armstrong, Westerman, Hattori, McLeland & Naughton

[57] ABSTRACT

This invention relates to an electrically conductive transparent material that is suitable for use as a feeding device and to a display device using the electrically conductive transparent material. The electrically conductive transparent material comprises a substrate unit made of an electrically insulating transparent material, and an electrically conductive transparent unit buried in the substrate unit. The electrically conductive transparent unit is provided in the form of a plurality of layers at fixed intervals within the substrate unit. Another electrically conductive transparent material comprises a substrate unit made of an electrically insulating transparent material, and an electrically conductive transparent unit buried in the substrate unit. The electrically conductive transparent unit consists of a plurality of electrically conductive wires that do not intersect with each other. The display device comprises the above-mentioned electrically conductive transparent material and display elements that, respectively, are connected to feeder terminals for a plurality of transparent conductive portions provided for the electrically conductive transparent material.

11 Claims, 21 Drawing Sheets

32

32

Fig.41
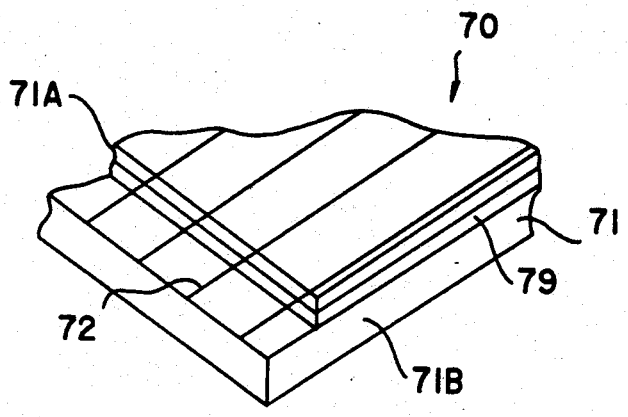
Fig.42
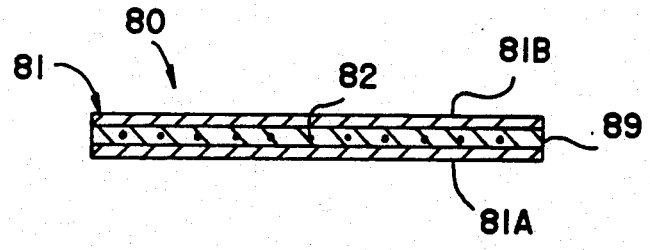
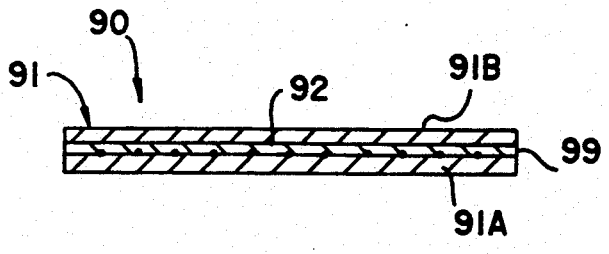
Fig.43

ELECTRICALLY CONDUCTIVE TRANSPARENT MATERIAL AND DISPLAY DEVICE USING THE ELECTRICALLY CONDUCTIVE TRANSPARENT MATERIAL

This is a division of application Ser. No. 261,968, filed Nov. 14, 1988, now abandoned.

TECHNICAL FIELD

This invention relates to an electrically conductive transparent material that is suitable for use as a feeding means for the supply of electricity and to a display device using the electrically conductive transparent material. The electrically conductive transparent material is suitable for use as a feeding means for various kinds of display devices such as information display boards, billboards, and the like.

BACKGROUND ART

Generally, display devices comprising display elements such as illuminants or the like are constructed by the attachment of the display elements on a support that is not transparent. However, because the support is not transparent, when the display device is being looked at, it can be seen that the display elements are held on the support. Thus, conventional display devices have poor display effects offered to the viewer. Also, depending on the direction in which the viewer is looking at the display device, the light emitted from the display elements may be obstructed by the support, in which case it may not be possible to see the display device clearly.

For these reasons, one possible solution is to form the support from a transparent material made of transparent resin or the like. When a display device constructed by the attachment of display elements to this kind of a transparent support is being looked at, the display elements look as if they are floating in air. For that reason, the display effects are improved, and the light emitted from the display elements is not obstructed by the support. However, if the support is made of a transparent material as is described above, there are the following defects.

There are feeding wires to supply electricity to the display elements that are attached to the support, which wires are disposed along the surface of the support, so the feeding wires can be seen from the outside. Thus, when the display device is being looked at from outside, the feeding wires can also be seen, and the appearance of the display device is damaged. It is necessary to attach the wires to the support so that they will not move, which lowers productivity. When a plurality of display devices are to be attached to the support, this tendency is even more marked.

A feeding means that looks transparent has not yet been suggested. There has been suggested an electrically conductive transparent material that is not a feeding means, but this is used as a means to prevent static electricity. This electrically conductive transparent material is made up of one layer of conductive mesh made of very thin strands, which conductive mesh is buried in a base made of an electrically insulating transparent material. Or, the electrically conductive transparent material is formed with the provision of a transparent conductive layer on the surface of the base.

However, because the electrically conductive transparent material that is used as a means to prevent static electricity is made up of one layer of a conductive mesh buried in a base, the electrically conductive transparent material cannot have its conductive mesh divided into two or more portions (positive and negative portions) electrically. Thus, it is not possible for conventional electrically conductive transparent materials to be used as a feeding means for the supply of electricity to both the positive and negative terminals of display elements, lighting equipments, or the like.

DISCLOSURE OF THE INVENTION

This invention solves the above-mentioned problems, and makes possible the objectives of providing an electrically conductive transparent material that is suitable for use as a feeding means that is transparent in appearance; and providing a display device comprising display elements that are not obstructed by the feeding means, with excellent display effects offered to the viewer, because the display elements look as if they were floating in the air when viewed from outside.

SUMMARY OF THE INVENTION

The electrically conductive transparent material of this invention comprises a substrate unit made of an electrically insulating transparent material, and an electrically conductive transparent unit buried in the substrate unit, the electrically conductive transparent unit being provided in the form of a plurality of layers at fixed intervals within the substrate units, thereby attaining the above-mentioned objectives. The electrically conductive transparent unit can be formed from an electrically conductive mesh. This electrically conductive mesh is preferably formed of electrically conductive wires with a diameter of 0.1 mm or less. The electrically conductive transparent unit can also be formed of a metal foil with a number of small pores.

Another electrically conductive transparent material of this invention comprises a substrate unit made of an electrically insulating transparent material, and an electrically conductive transparent unit buried in the substrate unit, the electrically conductive transparent unit consisting of a plurality of electrically conductive wires that do not intersect with each other, thereby attaining the above-mentioned objectives. The electrically conductive wires preferably have individual diameters of 0.1 mm or less. The electrically conductive transparent unit can also be formed from a plurality of electrically conductive wires that are arranged approximately in parallel and from electrically insulating wires that are contained in the network of the plurality of electrically conductive wires, as the fabricating material. It is preferable for the diameters of the electrically conductive wire and the electrically insulating wire to be 0.1 mm or less.

In the substrate unit that is provided for the electrically conductive transparent materials mentioned above, there can be provided a number of holes for the exposure of transparent conductive portions of the electrically conductive transparent unit. Also, the substrate unit can be formed by the attachment of a plurality of constituent substrates together by an adhesive, and the electrically conductive transparent unit can be arranged in the attached parts of constituent substrates. The electrically conductive transparent unit can be positioned from the central part in the direction of thickness of the substrate unit toward one surface of the substrate unit.

The electrically conductive transparent unit is comprised of transparent conductive portions made of a conductive mesh, metal foil with a number of pores, a number of electrically conductive wires, or the like, so an electrically conductive transparent material that has these transparent conductive portions looks transparent. The transparent conductive portions provided within the substrate unit can be insulated by use of the insulating substrate portion, so it is possible to divide the transparent conductive portions electrically into two or more portions (positive and negative portions). The electrically conductive transparent unit is provided within the substrate unit, so there is no possibility of a person coming into contact with the electrically conductive transparent unit from the outside to get an electric shock. When the electrically conductive transparent material is being transported or processed in manufacturing, there is no possibility of peeling or of damage from the contact of the electrically conductive transparent unit with outside objects. The electrically conductive transparent unit is buried in the substrate unit, so there is no exposure of the electrically conductive transparent unit outside of the substrate unit. Thus, there is no danger of corrosion of the electrically conductive transparent unit because of contact with outside air or of contamination by means of particles in the air or the like.

In particular, as the electrically conductive transparent unit consists of a plurality of electrically conductive wires that do not intersect with each other, and electrically insulating wires as the fabricating material, it is possible to bury the electrically conductive wires readily in the substrate unit at fixed intervals with accuracy. Also, the electrically conductive transparent material is installed over almost the entire surface of the substrate unit, so it is possible to expose the transparent conductive portions at any part of the substrate unit.

In this way, according to the electrically conductive transparent material of this invention, it is possible to provide the inside of the substrate unit with a plurality of transparent conductive portions that are electrically insulated. Therefore, it is possible to supply electricity to display elements and the like by the connection of both positive and negative terminals of the display elements and the like with the different transparent conductive portions in the center region or in the edge regions of the transparent substrate unit. Also, the electrically conductive transparent material of this invention is transparent and can be used as a safe and stable feeding means. This electrically conductive transparent material can be used as a transparent feeding means without scattering of the conductive portions, which can be used for an display device and the like.

The display device of this invention is provided with the above-mentioned electrically conductive transparent material and display elements that are each connected to feeder terminals for a plurality of transparent conductive portions provided for the electrically conductive transparent material, thereby attaining the above-mentioned objectives. Openings are formed in the substrate unit of the electrically conductive transparent material, and the display elements are placed in the openings, so that the feeder terminals of the display elements can be connected electrically with the transparent conductive portions. Also, around the openings, it is possible to position a plurality of the display elements. In addition, the substrate unit is provided with concave portions for exposure of the transparent conductive portions, and the display elements are placed in the concave portions; the display elements may be connected electrically with the transparent conductive portions. It is also possible for a plurality of the display elements that are arranged along the outside of the substrate unit to be connected electrically with the transparent conductive portions that are exposed on the outer edge surface of the substrate unit.

In the display device of this invention, feeding wires to supply electricity to the display elements are constructed of transparent conductive portions that are internalized in the transparent substrate unit. Thus, the display elements can operate in the inner section or outer section of the transparent space provided in the substrate unit, so that there cannot be seen intricate feeding wires in the inner transparent space. As the transparent conductive portions that support the display elements are transparent, the display elements seem to be floating in the air when the display device is being viewed. Thus, the viewer is given an unexpected impression, and the display effects are enhanced; also, because the display elements are not obscured by their support, it is possible to view the display of the display elements from any direction around the display device.

BRIEF DESCRIPTION OF THE DRAWINGS

FIG. 41 is a fragmentary perspective view of the electrically conductive transparent material.

FIGS. 42 to 46 are sectional views of still other examples of an electrically conductive transparent material.

BEST MODE FOR CARRYING OUT THE INVENTION

Example 1

Figure 1:
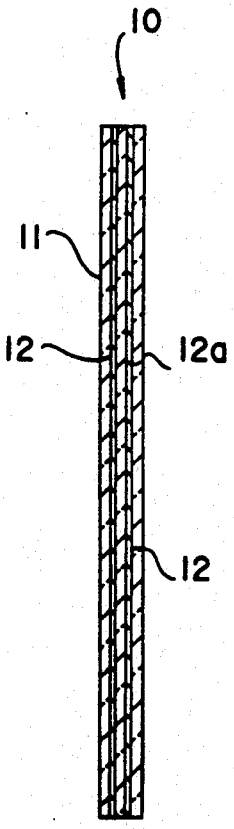
FIG. 1 is a sectional view of one example of an electrically conductive transparent material.
Figure 2:
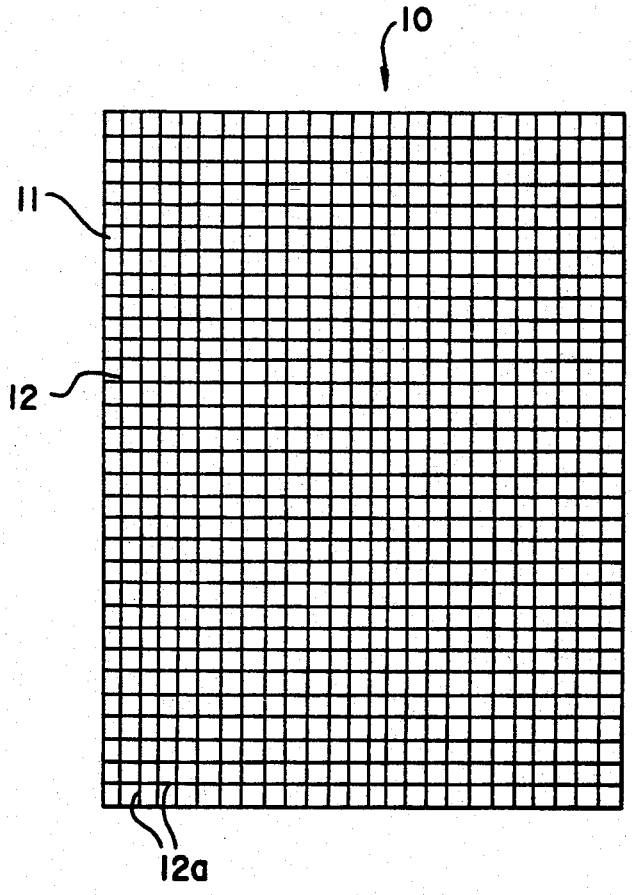
FIG. 2 is a plane view of the electrically conductive transparent material.

As shown in FIGS. 1 and 2, an electrically conductive transparent material 10 is comprised of a substrate unit 11 made of an electrically insulating transparent material and an electrically conductive transparent unit consisting of a plurality of transparent conductive portions 12 and 12 buried in the substrate unit 11 so as to be electrically insulated from each other.

The substrate unit 11 is made of an electrically insulating transparent material (such as resin, glass, and the like) that is uncolored or colored. The electrically conductive transparent unit 12 is provided in the form of a conductive mesh of electrically conductive wires 12*a* that are arranged in a network. The networks of conductive mesh 12 are arranged so as to make a plurality of layers inside the substrate unit 11 at fixed intervals. Because there is substrate material that has electrically insulating properties between the two conductive meshes 12 and 12, the conductive meshes 12 and 12 are both insulated electrically by the substrate material.

The cross-sectional shape of the electrically conductive wires 12*a* that form the conductive meshes 12 can be either circular or square. It is preferable that the diameter or width of the electrically conductive wires 12*a* be 0.1 mm or less. The spacing between two adjacent electrically conductive wires 12*a* and 12*a* can be set so that when a person is viewing the electrically conductive transparent material 10 from a direction that is approximately at right angles with respect to the outer surface of the electrically conductive transparent material 10, the transparent mesh 12 cannot be seen clearly. For example, when the strands of the conductive mesh 12 are electrically conductive wires 12*a* with a diameter of about 0.1 mm, the spacing between the adjacent electrically conductive wires 12*a* and 12*a* can be set at about 10 mm or more. When electrically conductive wires 12*a* with a diameter of about 20 μm are used as strands for the conductive mesh 12, the spacing between the adjacent electrically conductive wires 12*a* and 12*a* can be set at about 1 mm. As such electrically conductive wires 12*a*, there can be used metal strands such as gold wires, silver wires, copper wires, zinc wires, stainless steel wires, etc., or strands made of resin such as polyester wires, nylon wires, etc., the outer surface of which is covered with metal by vapor deposition, metal plating, or the like.

Figure 3:
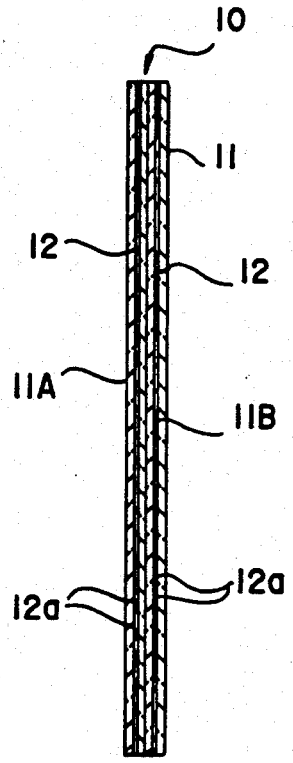
FIG. 3 is a sectional view of another example of an electrically conductive transparent material.
Figure 4A:
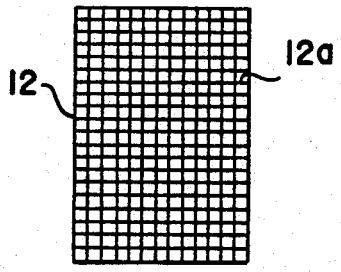
FIGS. 4A, 4B, and 4C are partial plan views of different conductive meshes.
Figure 4B:
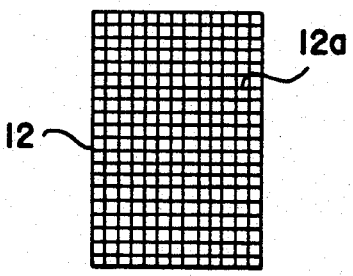
Figure 4C:
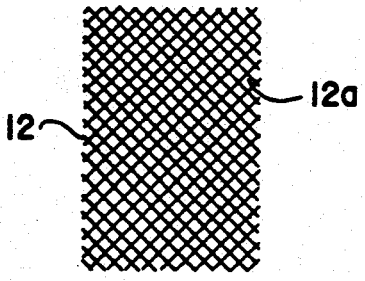

The electrically conductive transparent material 10, as shown in FIG. 3, can be formed integrally by the laminating together of two transparent plates 11A and 11B that are made of an electrically insulating transparent material, in which only one layer of the conductive mesh 12 mentioned above is buried. When two conductive meshes 12 and 12 are disposed so as to form parallel layers, that is, when the conductive mesh 12 of FIG. 4A is overlaid by the conductive mesh 12 of FIG. 4B, and the directionality of the electrically conductive wires 12*a* of the two conductive meshes 12 is the same or almost the same, a moire phenomenon occurs, and the transparency of the electrically conductive transparent material 10 is decreased; at the same time, the appearance is intricate, which is not appropriate. Therefore, when the electrically conductive transparent material 10 is manufactured, it is preferred that the conductive mesh 12 of FIG. 4A is overlaid by the conductive mesh 12 of FIG. 4C so that the directionalities of the electrically conductive wires 12*a* and 12*a* of the two conductive meshes 12 and 12 are at 45° with respect to each other.

A display device 1 using an electrically conductive transparent material 10 constructed in this way is made as follows.

Figure 5:
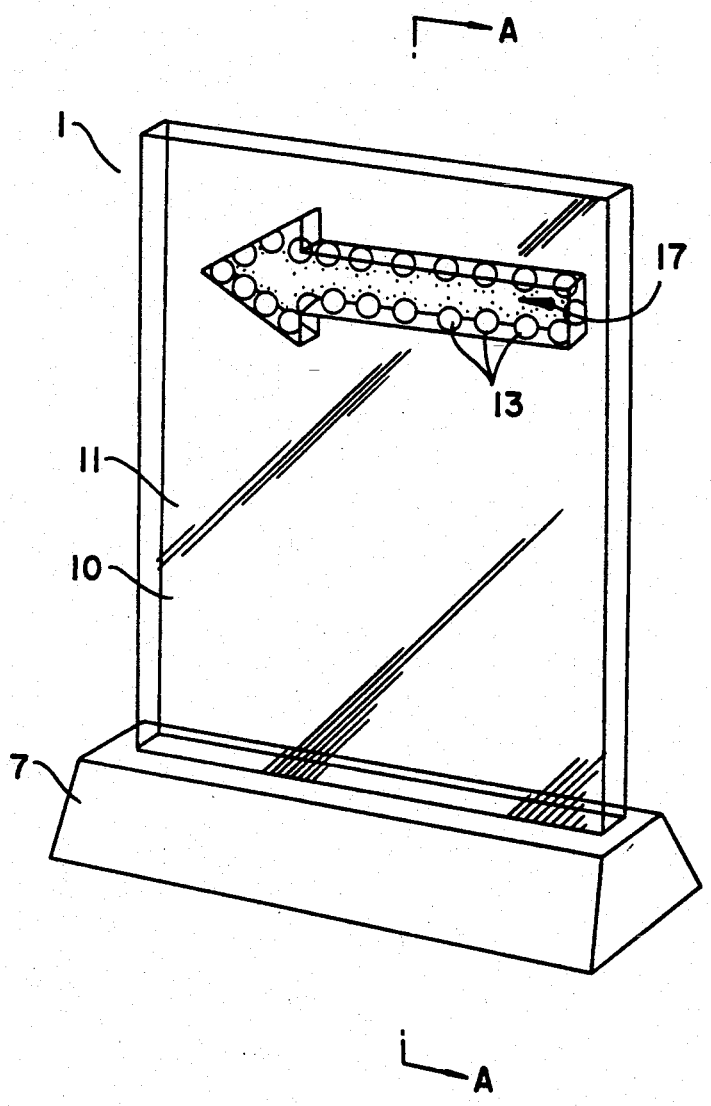
FIG. 5 is a perspective view of a display device using an electrically conductive transparent material.
Figure 6:
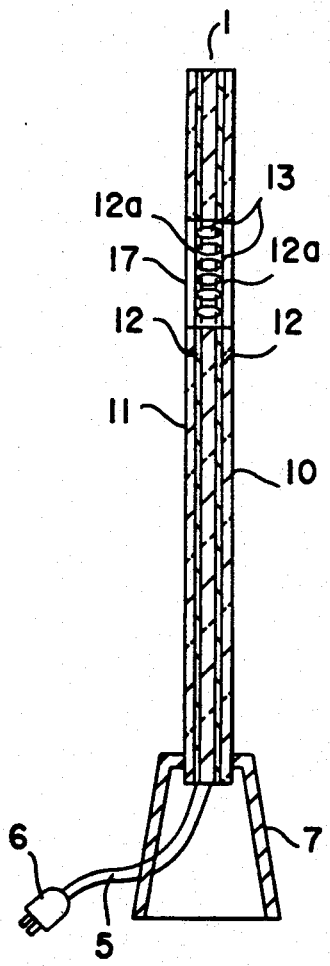
FIG. 6 is a sectional view taken at line A—A of FIG. 5.
Figure 7:
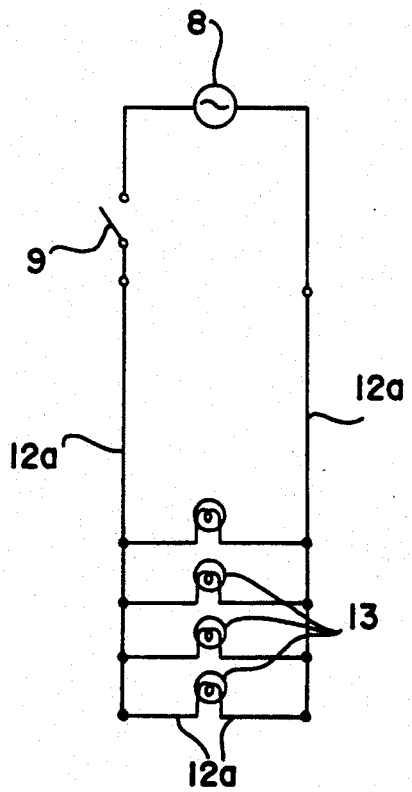
FIG. 7 is an electric circuit diagram of the display device.

As shown in FIGS. 5 to 7, the display device 1 is provided with the electrically conductive transparent material 10, a foot section 7 that supports the electrically conductive transparent material 10 in a vertical portion, and light bulbs 13 as one example of display elements that are connected to their feeder terminals on the conductive mesh 12 of the electrically conductive transparent material 10.

At the bottom edge of the electrically conductive transparent material 10, a pair of conductive meshes 12 and 12 that have their electrically conductive wires 12*a* and 12*a* exposed are connected to a cord 5, the cord 5 being connectable to an electrical power source by means of a plug 6 that is attached to the end of the cord 5. There is an arrow-shaped opening 17 in the electrically conductive transparent material 10, formed by the cutting out of a portion of the electrically conductive transparent material 10. Around the edges of this opening 17, there are a plurality of ends of the above-mentioned electrically conductive wires 12*a* that are buried in the electrically conductive transparent material 10. A number of light bulbs 13 are fixed in place along the edges of the opening 17, and the feeder terminals (positive and negative terminals) of the light bulbs 13 are connected to the exposed portions (positive portions) of electrically conductive wires 12*a* that are exposed as mentioned above.

FIG. 7 is a schematic diagram showing the electrical circuit of the display device 1. In this figure, the electrical source is represented by reference numeral 8, and the switch is represented by reference numeral 9.

With the display device 1 mentioned above, if the light bulbs 13 around the edges of the opening 17 formed in the electrically conductive transparent material 10 are lighted, the light bulbs seem to be floating in the air when this electrically conductive transparent material 10 is viewed. Also, the existence of the feeding wires 12 to supply electricity to the light bulbs 13 cannot be seen from its surroundings, resulting in an uncluttered appearance for the display device 1.

Also, in the practice of this invention, the electrically conductive transparent unit 12 that is internalized in the substrate unit 11 can be formed from parallel wires made of 2 or more extremely thin strands or else from conductive films of vapor-deposited $SiO_2$-indium alloy. Display elements 13 can be, in addition to light bulbs, fluorescent lights, neon tubes, light-emitting diodes, microminiature lamps, electroluminescent panels, plasma display panel lamps, and other illuminants. In addition, in this example, as objects to which electrically conductive wires 12*a* of electrically conductive transparent material 10 can supply electricity, there are liquid-crystal display panels, display panels using electrochromic display lights, magnetic fluids for which the magnetic properties can be changed electrically, and sound display devices such as speakers.

Example 2

Figure 8:
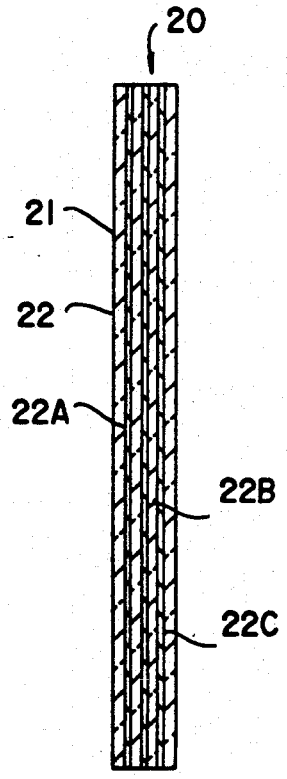
FIG. 8 is a sectional view of another example of an electrically conductive transparent material.
Figure 9:
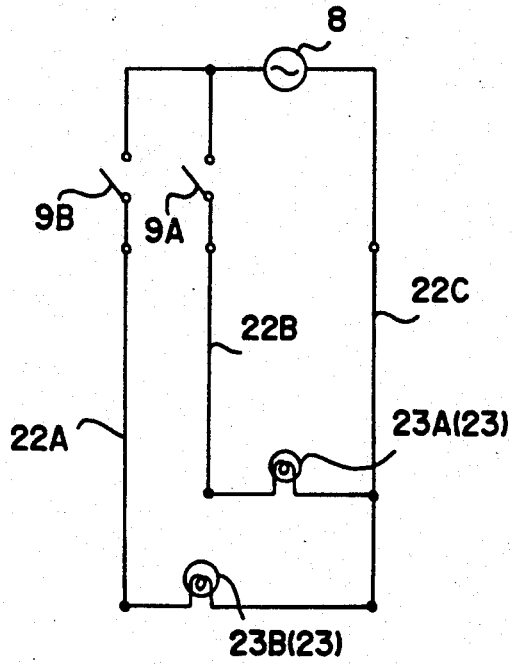
FIG. 9 is an electric circuit diagram

FIG. 8 and FIG. 9 show other examples of electrically conductive transparent materials 20. In this electrically conductive transparent material 20, three conductive portions 22A, 22B, and 22C are buried together at certain intervals in the substrate unit 21 so as to form parallel layers. When this electrically conductive transparent material 20 is used to construct a display device 2, transparent conductive portions 22A, 22B, and 22C are exposed on the outer surfaces of the edges of electrically conductive transparent material 20 or on the edges of an opening in electrically conductive transparent material 20 that are connected to the feeder terminals of the light bulbs 23 (23A and 23B). The transparent conductive portion 22C shown in FIG. 9 functions as the common wire. The reference numeral 8 in the figure is the power source, and the reference numerals 9A and 9B are switches. With this display device, the switching on and off the light bulbs 23A and 23B can be controlled independently, and it is possible to bring about a change in the display condition. Moreover, the transparent conductive portions 22 internalized in the base 21 can be multilayered, with four or more layers. With this display device 2, it is possible to supply electricity to the light bulbs 23A and 23B independently, so as to have a complex pattern of lighting; if a number of light bulbs 23 are connected, it is possible, for example, to turn on the light bulbs in order from the first light bulb 23 to the last light bulb 23, followed by turning on all of the light bulbs 23 at the same time, and to repeat this procedure.

Example 3

Figure 10:
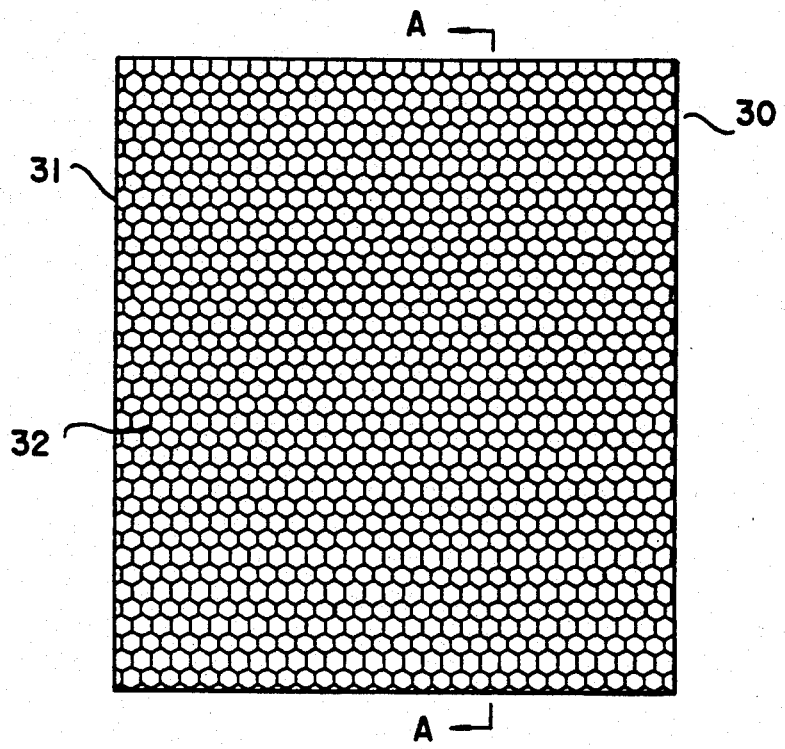
FIG. 10 is a plan view of still another example of an electrically conductive transparent material.
Figure 11:
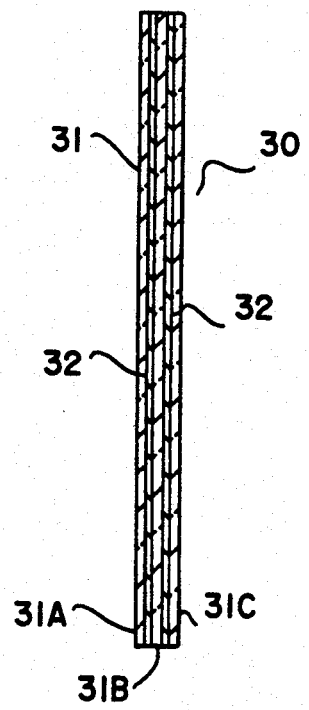
FIG. 11 is a section view taken at line A—A of FIG. 10.
Figure 12:
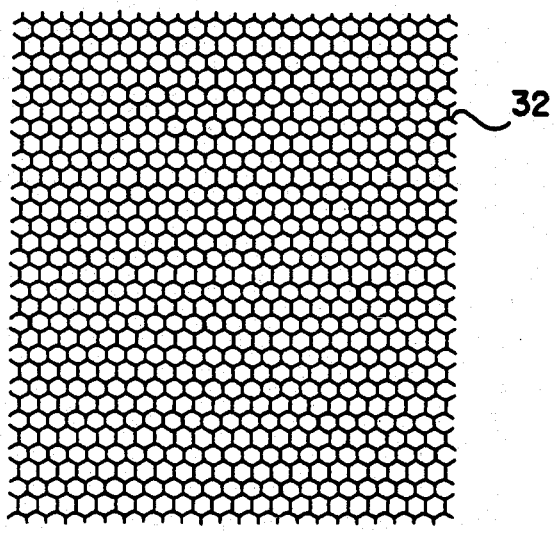
FIGS. 12 to 17 are plan views of different metal foils with a number of pores.
Figure 13:
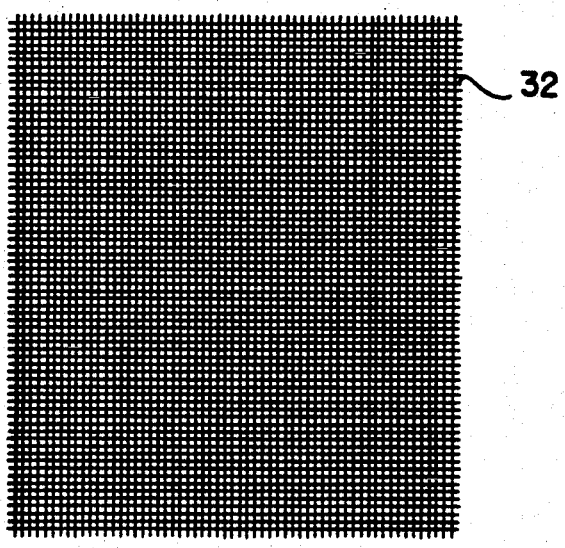
Figure 14:
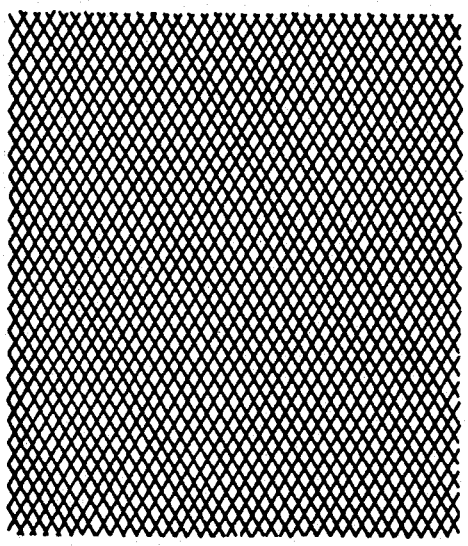
Figure 15:
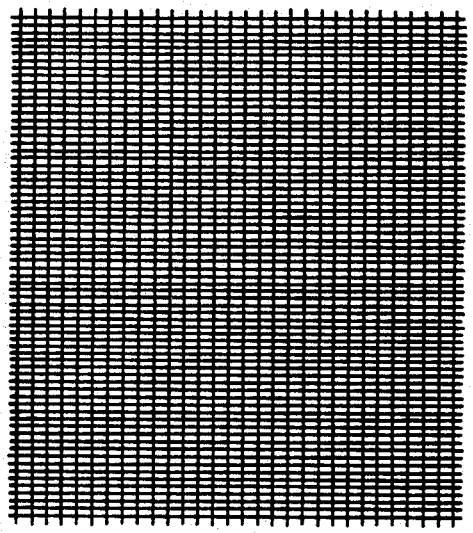
Figure 16:
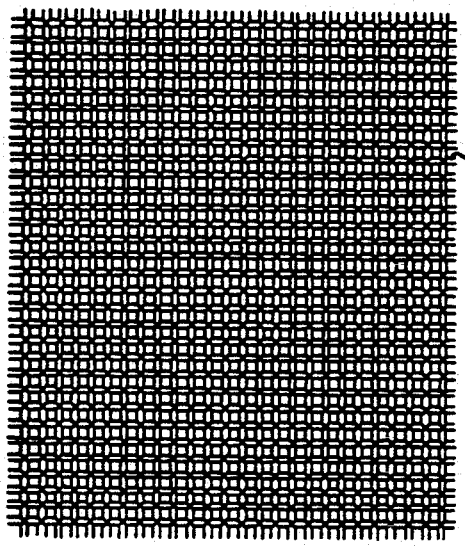
Figure 17:
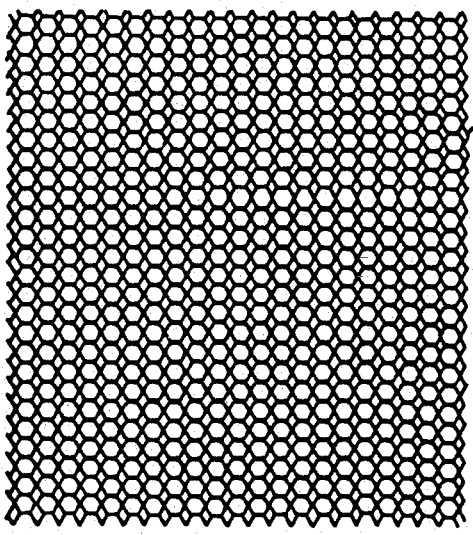

FIG. 10 and FIG. 11 shown another example of the electrically conductive transparent material 30 of this invention. The electrically conductive transparent material 30 has electrical insulation constructed in the same way as the substrate unit of Example 1; it also has three transparent plates 31A, 31B, and 31C (substrate unit 31) and transparent conductive portions 32 that are inserted in the spaces between the transparent plates 31A, 31B, and 31C.

The electrically conductive transparent unit 32 is provided in the form of a metal foil with a number of small pores therein, and the metal foils 32 are positioned so as to be inserted in the spaces between the transparent plates 31A, 31B, and 31C. Thus, two sheets of metal foil 32 constitute the layers that are insulated electrically with the transparent plate 31B interposed therebetween. The three transparent plates 31A, 31B, and 31C can be made of the same material or of different materials.

The electrically conductive transparent material 30 can be made as shown in either 1 or 2 below.

1. On the surface of the transparent plate 31A made of synthetic resin, the above-mentioned metal foil 32 with a number of pores, a transparent plate 31B made of synthetic resin, and another metal foil 32, on which there is transparent plate 31C made of synthetic resin, are arranged in layers, in this order. Next, this layered structure is heated, and also pressed from above and below, so as to make the layered structure into one piece by fusion of the resin.

2. On the surface of transparent plate 31A made of synthetic resin, the above-mentioned metal foil 32, a transparent plate 31B made of synthetic resin, another metal foil 32, and a transparent plate 31C made of synthetic resin are arranged in layers, in this order. Also, into the spaces between the metal foils 32 and 32 and the transparent plates 31A, 31B, and 31C, there is introduced a transparent adhesive agent. Next, the adhesive agent is allowed to harden, which makes the layered structure into one piece.

In FIGS. 12 to 17, various kinds of metal foils 32 that are used in this example are shown. The small pores provided in the metal foil 32, for example, are opened by use of the photolithographic method so as to be a fixed shape by being etched, or they can be opened by use of a mechanical means so as to be of a fixed shape by being punched, but the method to be used is not limited thereto, and any means that can give a number of small pores of a fixed shape can be used. There is no special restriction as to the shape of the small pores. Also, the material used for the metal foil can be copper, iron, stainless steel, aluminium, or other materials that can be formed into a foil.

It is preferable for the thickness of the metal foil 32 to be 30 μm or less, and for the width of the wire to be 30 μm or less; the permeability of the metal foil 32 to light should be 70% or more. If the thickness of the metal foil 32 is 30 μm or more, if the width of the wire is 30 μm or more, or if the permeability of the metal foil 32 to light is 70% or less, the transparency of the electrically conductive transparent material 30 that is made therewith will be decreased. Then, in a display device 3 that is constructed by the installation of display elements 33 on both sides of such an electrically conductive transparent material 30, when the display elements 33 on both sides are observed from one side, the clearness of the display of the display elements 33 on the other side is decreased.

Figure 18:
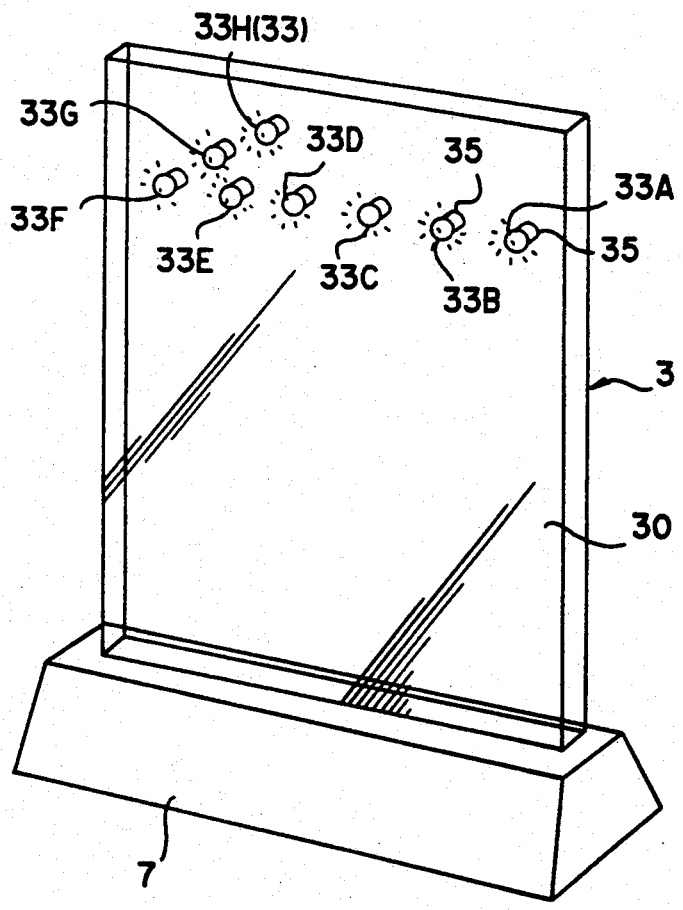
FIG. 18 is a perspective view of another example of a display device.

Also, as is shown in FIG. 18, it is possible to form attached holes 35 for a number of display elements 33 in the substrate unit 31, which attached holes 35 extend to both metal foils 32 and 32. Attached holes 35 can also be formed where the display elements 33 of the electrically conductive transparent material 30 are to be inserted. In this example, the light bulbs 33A to 33H are arranged so as to light up in order, making an arrow that indicates an entrance.

Figure 19:
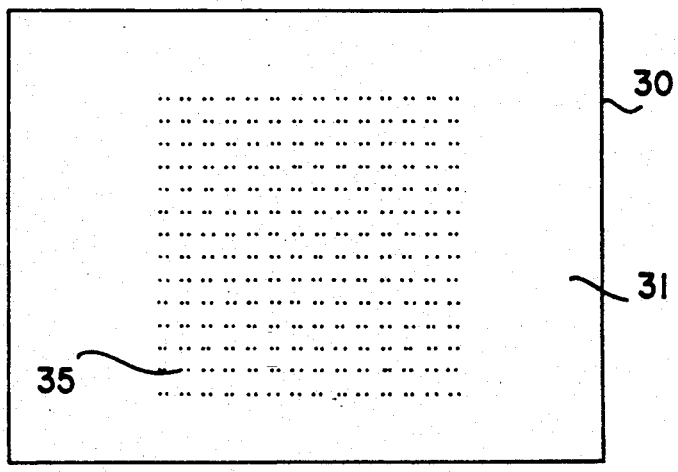
FIGS. 19 to 21 are plan views of other examples of an electrically conductive transparent material.
Figure 20:
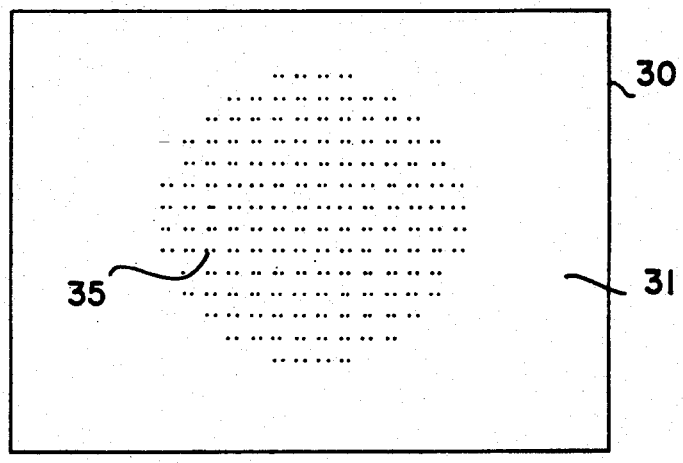
Figure 21:
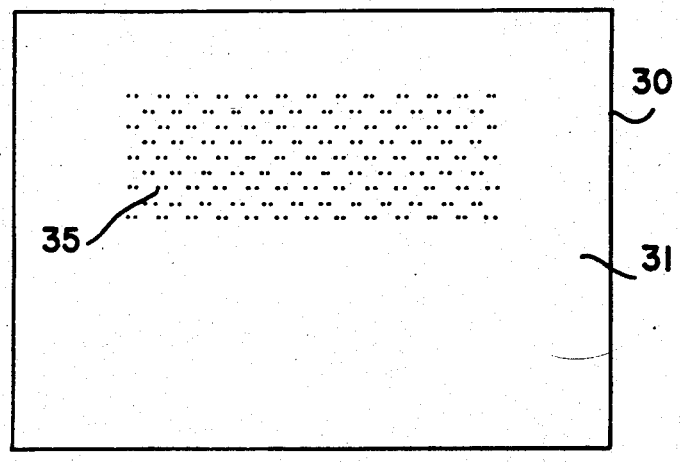

In addition, as shown in FIGS. 19 to 21, if a number of attached holes 35 are formed in a variety of patterns in the substrate unit 31, the display elements 33 can be simply inserted in the required positions, which is convenient when changing the design of the electrically conductive transparent material 30 by alternation of the places in which the display elements are installed. That is, by the formation in substrate unit 31 of attached holes 35 in which the display elements 33 can be placed or from which they can be removed, the pattern, lettering, color, etc., of the electrically conductive transparent material 30 can be changed at will.

Figure 22:
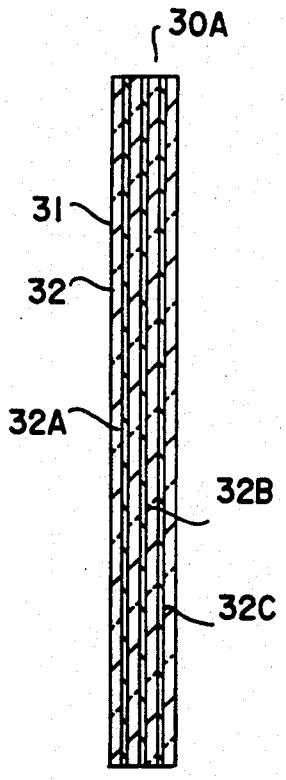
FIG. 22 is a sectional view of still another example of an electrically conductive transparent material.
Figure 23:
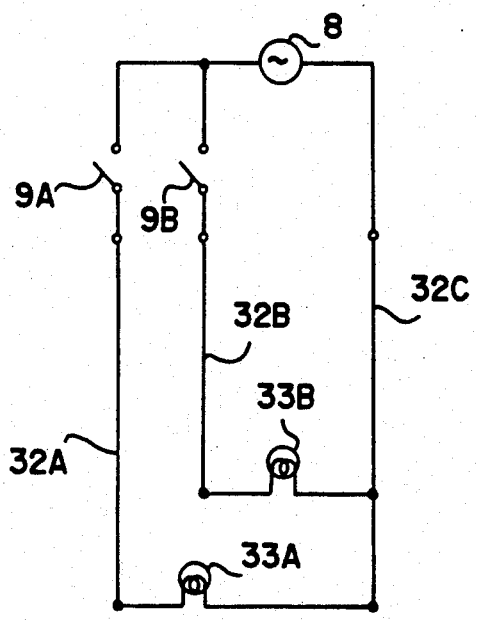
FIG. 23 is an electric circuit diagram.
Figure 24:
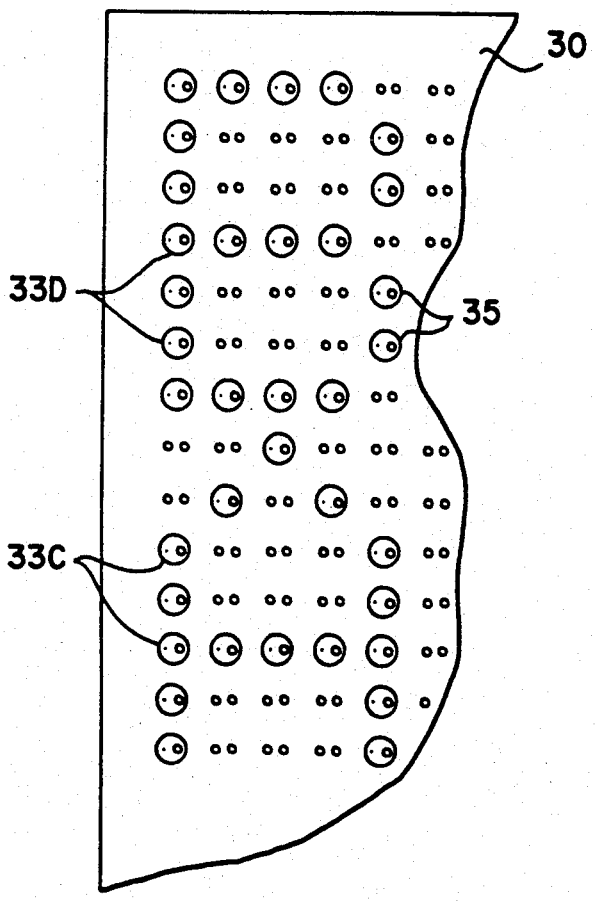
FIG. 24 is a fragmentary plan view of still another example of an electrically conductive transparent material.
Figure 25:
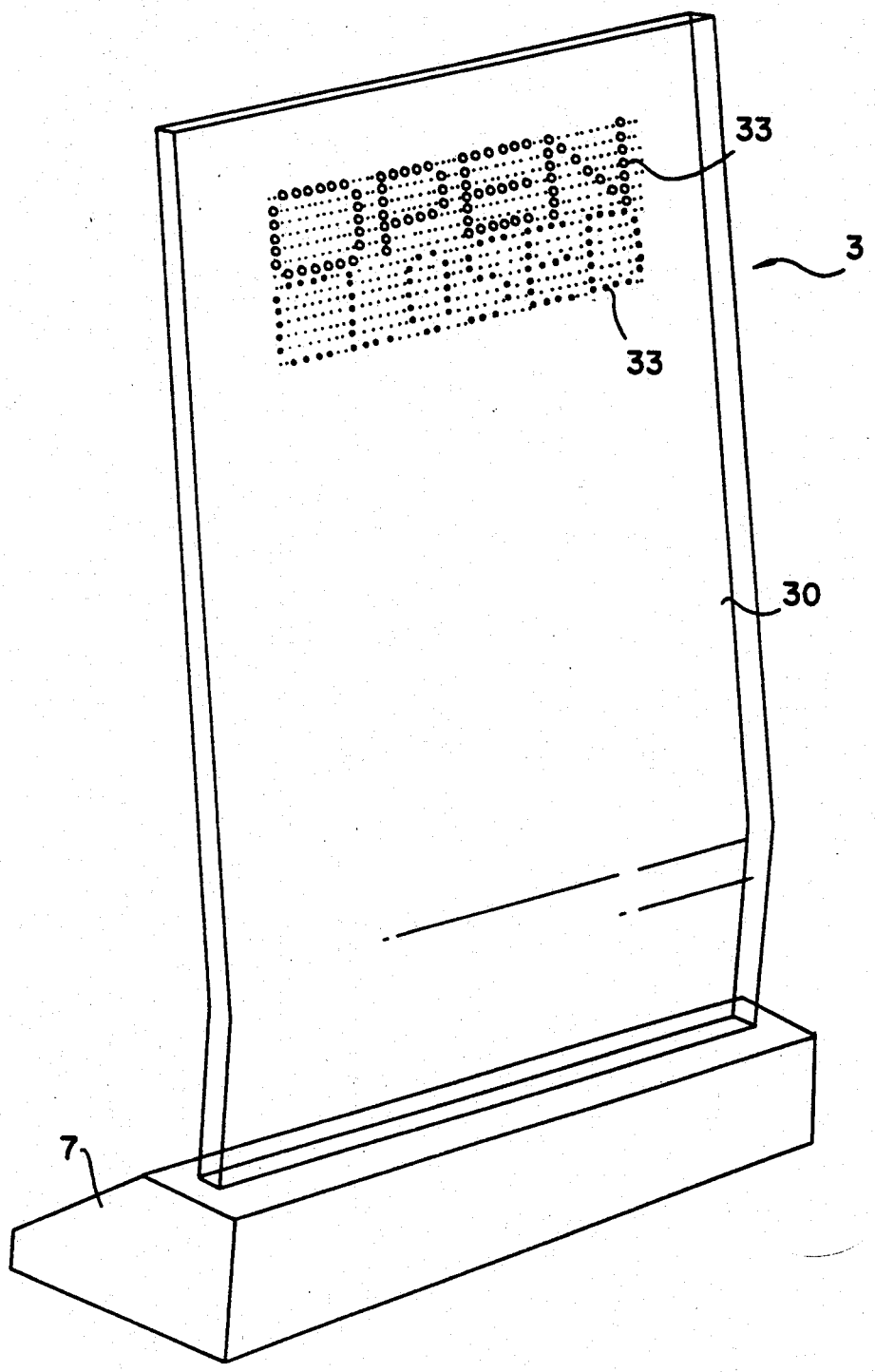
FIG. 25 is a perspective view of still another example of a display device.

FIG. 22 shows another example of the electrically conductive transparent material 30A of this invention. The electrically conductive transparent material 30A is different from the electrically conductive transparent material 30 mentioned above in that the three layers of metal foils 32A, 32B, and 32C, are buried therein. As shown in FIGS. 23 to 25, the metal foils 31A, 31B, and 31C are exposed at the surfaces of the outer part of the electrically conductive transparent material 30 or at the attached holes 35, and the exposed portions of the metal foils 31A, 31B, and 31C can be connected with the feeder terminals of light bulbs 33A and 33B. Metal foil 32C functions as the common wire. Reference numeral 8 in the figure is the power source and reference numerals 9A and 9B are the switches. In the display device 3 with this electrical circuit, the turning on and off of the light bulbs 33A and 33B can be controlled independently, so it is possible to bring about a change in the display condition.

FIG. 24 is an partially enlarged plan view of an electrically conductive transparent material 30 in which attached holes 35 for display elements are opened over the entire surface, and light-emitting diodes 33C are installed so as to form a pattern of the letters A and B. In FIG. 24, the positive terminals (shown in the figure as black dots) of the light-emitting diodes 33C (which correspond to the 33A of the electrical circuit shown in FIG. 23) that are arranged in the pattern of a letter A are connected to the metal foil 32A, and the negative terminals (shown in the figure as white dots) are connected to the metal foil 32C; the positive terminals (shown in the figure as black dots) of the light-emitting diodes 33D (which correspond to the 33B of the electrical circuit of FIG. 23) that are arranged in the pattern of a letter B are connected to the metal foil 33B, and the negative terminals (shown in the figure as white dots) are connected to the metal foil 33C. By the control of the opening and closing of the switches 9A and 9B, it is possible to illuminate only the letter A, only the letter B, or both the letters A and B at the same time.

FIG. 25 is a perspective view showing one example of a display device 3 employing the principles shown in FIGS. 23 and 24 above. The white dots show an illuminated light, and the black dots show a light that is not illuminated. For example, during business hours, the display elements 33 that are arranged in a pattern that spells out the word "OPEN" can be illuminated, and after business hours, the display elements 33 that are arranged in a pattern that spells out the word "CLOSED" can be illuminated, while the display elements 33 that are arranged in the pattern that spells out the word "OPEN" are turned off.

Also, in this example, it is possible to have a plurality of layers of metal foil 32 numbering 4 layers or more internalized in the substrate unit 31. It is not necessary to arrange the metal foils 32 at the center part in the direction of thickness of the substrate unit 31; it is possible to have a layer extending from the central position in the direction of thickness toward one surface. The kinds of display elements 33 listed in Example 1 above are all suitable for use in this example, as well.

Example 4

Figure 26:
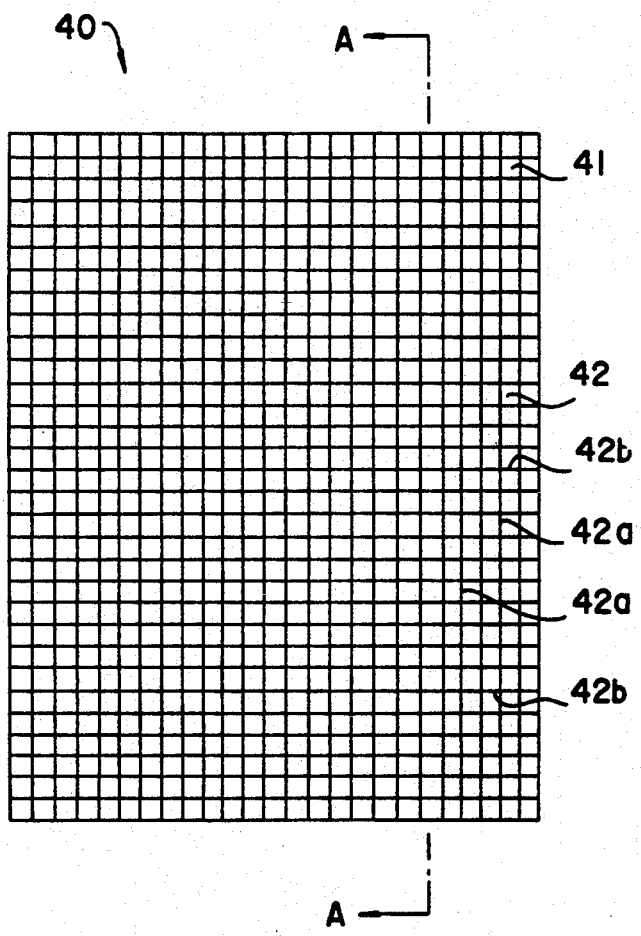
FIG. 26 is a plan view of still another example of an electrically conductive transparent material.
Figure 27:
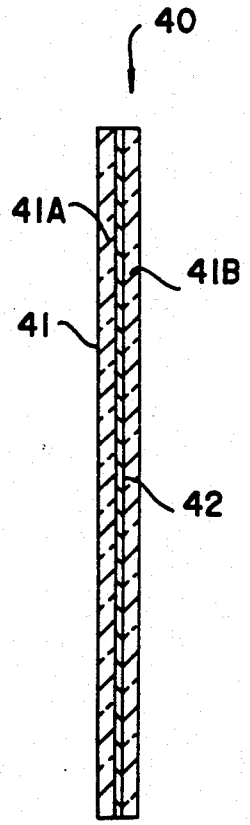
FIG. 27 is a section view taken at line A—A of FIG. 26.
Figure 28:
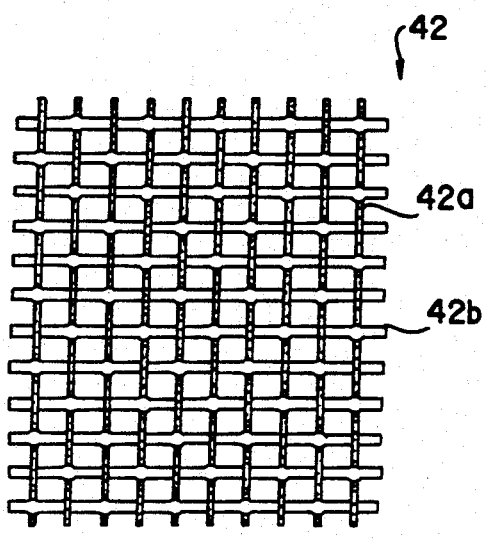
FIGS. 28 to 36 are partial plan views of different conductive meshes.
Figure 29:
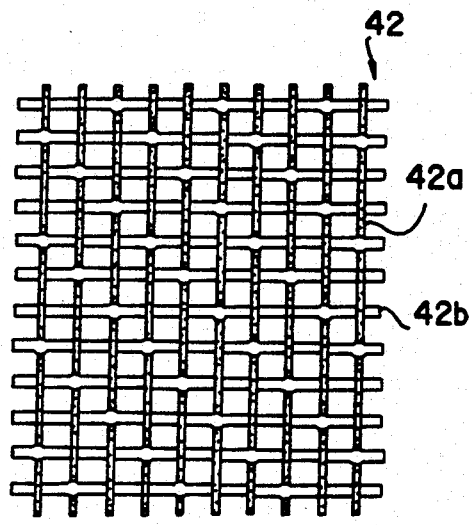
Figure 30:
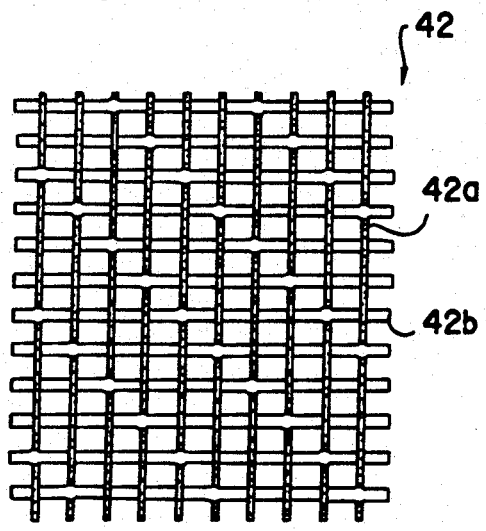
Figure 31:
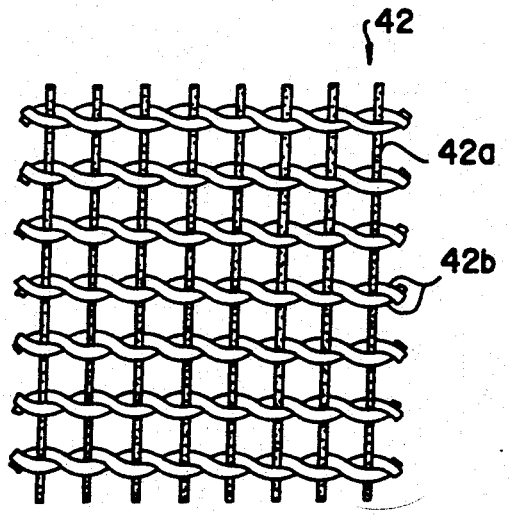
Figure 32:
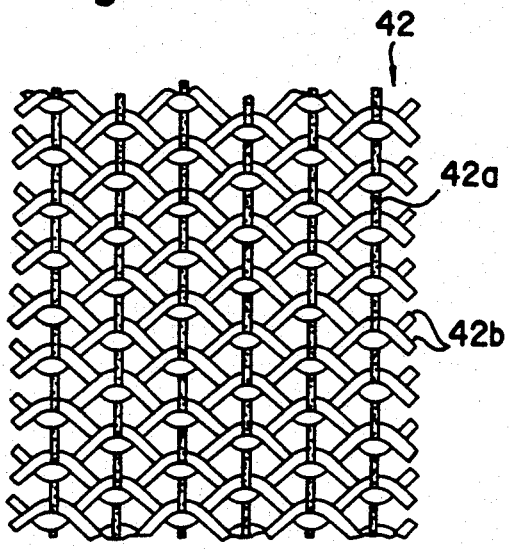
Figure 33:
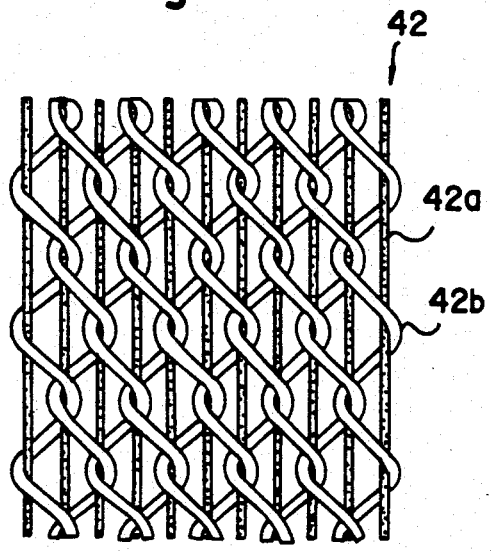
Figure 34:
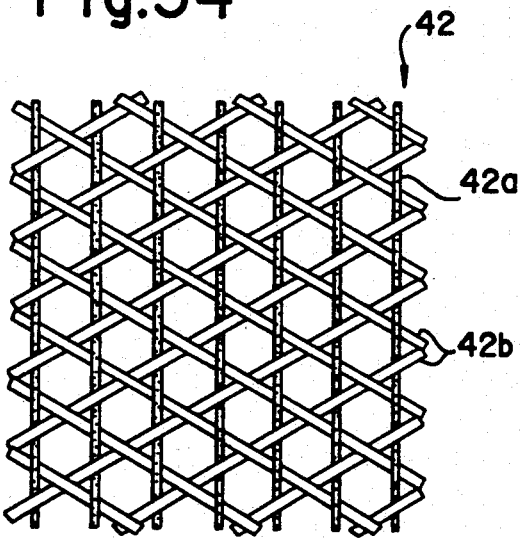
Figure 35:
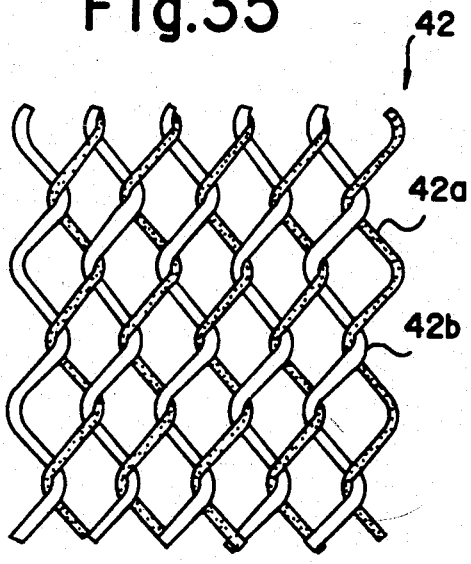
Figure 36:
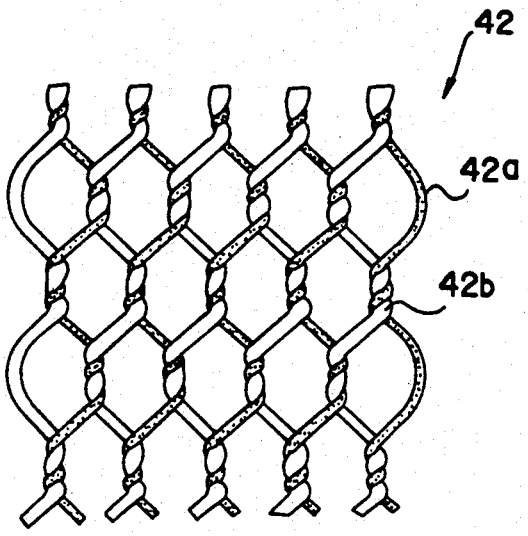

FIGS. 26 and 27 show another electrically conductive transparent material 40 of this invention.

In this example, the electrically conductive transparent material 40 comprises a pair of transparent plates 41A and 41B (substrate unit 41) that form a plate (the constituent substrate) made of an electrically insulating transparent material of synthetic resin, glass sheets, or the like, and a conductive mesh 42 installed between the two transparent plates 41A and 41B. The transparent plates 40A and 40B can be made of the same material or of different materials.

The conductive mesh 42 is constructed, as shown in FIGS. 28 to 36, of a network in which a plurality of mutually parallel electrically conductive wires 42*a* are combined with electrically insulating wires 42*b* as the fabricating material. The material that is used for the electrically conductive wires 42*a* and the spacings between the adjacent electrically conductive wires 42*a* and 42*a* can be the same as described in Example 1 above. The electrically conductive wires 42*a* are formed from very fine strands with a diameter or a width of 0.1 mm or less. As the electrically insulating wires 42*b*, there can be used strands made of resin such as polyester wires, nylon wires, etc. In an electrically conductive transparent material 40 constructed in this way, electrically conductive wires 42*a* and electrically insulating wires 42*b* that constitute a conductive mesh 42 are made of very fine strands, so the entire structure is transparent, and may be either colorless or colored. Also, the electrically conductive transparent material 40 has buried in the substrate unit 41 a conductive mesh 42 that has electrically insulating wires 42*b* as the fabricating material, so it is possible to establish and maintain the fixed spacing of the electrically conductive wires 42*a* with accuracy and ease.

The electrically conductive transparent material 40 has a conductive mesh 42 buried at about the center part in the direction of thickness of the substrate unit 41, so that the transparent plate 41A or 41B can be removed in parts, and the adhesive layer can be removed by use of a solvent, so as to expose portions of the electrically conductive wires 42*a* of the conductive mesh 42, so that they can be used as terminals for the supply of electricity.

Also, the combined condition of the electrically insulating wires 42*b* with the electrically conductive wires 42*a* has a plurality of possibilities, as is shown in FIGS. 28 to 36.

The electrically conductive transparent material 40 can be manufactured by the methods numbered 1 to 3 below.

1. On top of a transparent plate 41A, a conductive mesh 42 is placed. Next, on top of the transparent plate 41A and the conductive mesh 42, an adhesive layer is formed by the application of a transparent adhesive agent in liquid form or by the attachment of a transparent adhesive agent in sheet form. Thereafter, while the adhesive layer is not yet hardened, another transparent plate 41B is placed on top of the adhesive layer and fixed by the application of pressure.

2. On top of a transparent plate 41A, a conductive mesh 42 is placed. Next, on top of the transparent plate 41A and the conductive mesh 42, an adhesive layer is formed by the application of a transparent adhesive agent in liquid form or by the attachment of a transparent adhesive agent in sheet form, and the adhesive layer is allowed to harden. After the adhesive layer has hardened, an electrically insulating transparent material in liquid form is poured (or sprayed) on top of the adhesive layer and allowed to harden, which electrically insulating transparent material forms a transparent plate 41B when it has hardened.

3. On top of a transparent plate 41A, a conductive mesh 42 is placed. Next, the transparent plate 41A is softened by the application of heat, and at the same time, the conductive mesh 42 is pressed into the surface of the transparent plate 41A by the application of pressure, by which means the conductive mesh 42 is attached to the transparent plate 41A. Thereafter, in the same way as is described above, a transparent plate 41B is formed on top of the adhesive layer in liquid form or sheet form.

Example 5

Figure 37:
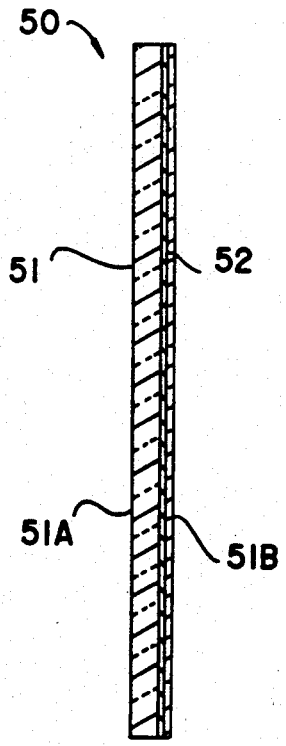
FIG. 37 is a section view of still another example of an electrically conductive transparent material.

A different form of Example 4 is shown in FIG. 37.

In this example, a substrate unit 51 is formed from a transparent plate 51A made of an electrically insulating transparent material, and an adhesive layer 51B. An electrically conductive transparent material 50 is comprised of a conductive mesh 52 placed toward one surface of the transparent plate 51A, and an adhesive layer 51B to attach the conductive mesh 52 onto the transparent plate 51A. The adhesive layer 51B is formed from a thin film that is thinner than the transparent plate 51A, being for example, a thin film with the thickness of 2 mm or less, so the conductive mesh 52 can be positioned off-center toward the surface of the electrically conductive transparent material 50. By the dissolving of this adhesive layer 51B by use of a solvent, it is possible to obtain the terminals readily for the supply of electricity. Also, by the dissolving of one part of the transparent plate 51A that constitutes the substrate unit 51, it is possible to expose one part of the electrically conductive wires 52 that are internalized within the substrate unit 51, and therefore to use them as terminals for the supply of electricity.

Example 6

Figure 38:
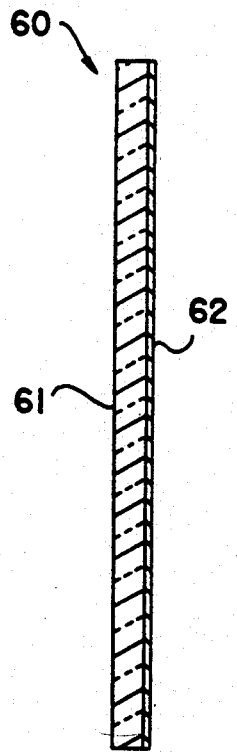
FIG. 38 is a sectional view of still another example of an electrically conductive transparent material.

Another different form of Example 4 is shown in FIG. 38.

The electrically conductive transparent material 60 has a substrate unit 61 that can be melted by the application of heat, and a conductive mesh 62 that is half-buried in the surface of the substrate unit 61 by the use of heat-fusion. Although one part of the conductive mesh 62 is exposed on the surface of substrate unit 61, there is no problem when a small electrical current that has no effect on the human body flows through the conductive mesh 62. When a large electrical current that can cause an electric shock to the human body flows through the conductive mesh 62, the surface of the conductive mesh 62 must be covered with an electrically insulating transparent material after the feeder terminals are connected to the conductive mesh 62. Two pieces of electrically conductive transparent material 60 constructed in this ways are arranged so that the exposed portions of their conductive meshes 62 face each other, and the resulting structure can be used as a touch panel as well. Also, before the adhesive layer applied on the surface of the substrate unit 61 has hardened, the conductive mesh 62 is buried in the adhesive layer so as to be half-buried and half-exposed at the surface of the substrate unit 61, and then the adhesive layer can be allowed to harden. Also, when the substrate unit 61 made of synthetic resin is formed, it is possible to bury a part of the conductive mesh 62 inside the substrate unit 61, providing an electrically conductive transparent material 60.

Example 7

Figure 39:
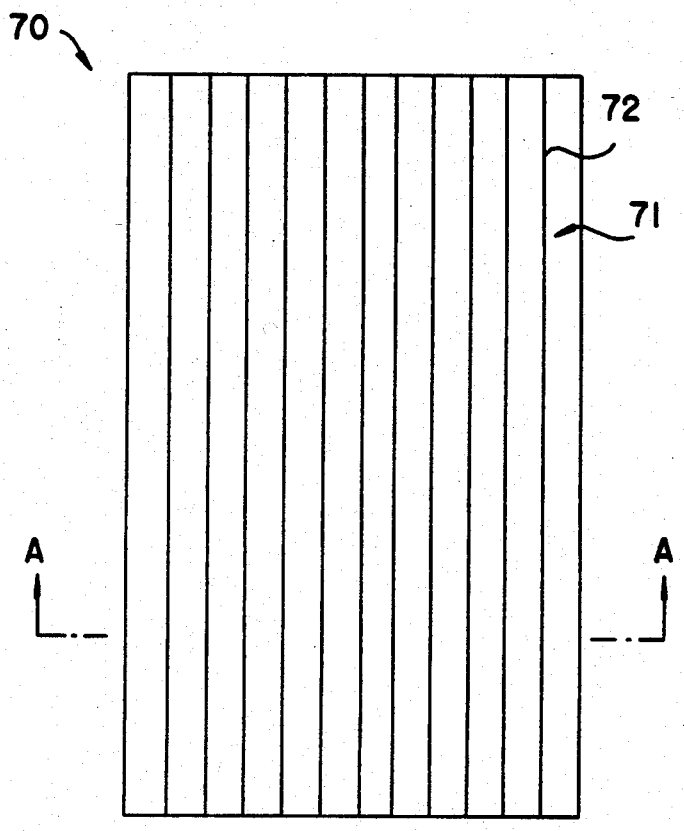
FIG. 39 is a plan view of still another example of an electrically conductive transparent material.
Figure 40:
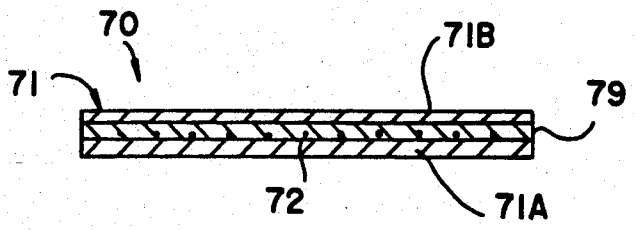
FIG. 40 is a sectional view taken at line A—A of FIG. 39.

Yet another example is shown in FIGS. 39 to 41. This electrically conductive transparent material 70 is comprised of, as transparent conductive portions, a plurality of electrically conductive wires 72 that are lined up inside a plate-shaped substrate unit 71 so as to be approximately parallel to each other.

The substrate unit 71 has a pair of transparent plates 71A and 71B made of an electrically insulating transparent material, and an adhesive layer 79 that connects the two transparent plates 71A and 71B to each other. The electrically conductive transparent material 70 can be manufactured in the same way as in Example 4 above. This electrically conductive transparent material 70 has internalized therein a plurality of electrically conductive wires 72 that are lined up so as to be approximately parallel to each other, so it is possible to separate the electrically conductive wires 72 into two or more regions electrically, and in addition, the same effects as for the above examples can be obtained.

Example 8

A different form of Example 7 is shown in FIGS. 42 to 46.

The electrically conductive transparent material 80 shown in FIG. 42 is comprised of a substrate unit 81 made of an electrically insulating transparent material, and a plurality of electrically conductive wires 82. The substrate unit 71 has a pair of transparent plates 81A and 81B made of an electrically insulating transparent material, and an adhesive layer 89 that connects the two transparent plates 81A and 81B to each other. This electrically conductive transparent material 80 can be manufactured as follows.

1. On top of a transparent plate 81A, an adhesive layer 89 is formed by the application of a transparent adhesive agent in liquid from or by the attachment of a transparent adhesive agent in sheet form. A plurality of electrically conductive wires 82 are arranged in parallel on top of the adhesive layer 89. Next, on top of the electrically conductive wires 82, a thicker adhesive layer 89 is formed by the application of a transparent adhesive agent in liquid from or by the attachment of a transparent adhesive agent in sheet form. Subsequently, while the adhesive layer 89 is not yet hardened, another transparent plate 81B is placed on top of the adhesive layer 89 and fixed by the application of pressure. Thereafter, the adhesive layer 9 is allowed to harden.

2. On top of a transparent plate 81A, an adhesive layer 89 is formed by the application of a transparent adhesive agent in liquid form or by the attachment of a transparent adhesive agent in sheet form. On top of the adhesive layer 89, a plurality of electrically conductive wires 82 are arranged in parallel. Next, on top of the electrically conductive wires 82, a thicker adhesive layer 89 is formed by the application of a transparent adhesive agent in liquid form or by the attachment of a transparent adhesive agent in sheet form, and then the adhesive layer 79 is allowed to harden. After the adhesive layer 89 has hardened, an electrically insulating transparent material in liquid form is poured (or sprayed) on top of the adhesive layer 89 and allowed to harden, which electrically insulating transparent material forms a transparent plate 81B when it has hardened.

Example 9

An electrically conductive transparent material 90 of this invention can also be manufactured as is shown in FIG. 43.

1. On top of a transparent plate 91A, a plurality of electrically conductive wires 92 are applied with heat and pressure so as to bury them half-way. Next, on top of the transparent plate 91A and the electrically conductive wires 92, an adhesive layer 99 is formed by the application of a transparent adhesive agent in liquid form or by the attachment of a transparent adhesive agent in sheet form. When this adhesive layer 99 has not hardened, another transparent plate 91B is placed on top of the adhesive layer 99 and fixed by the application of pressure.

2. On top of a transparent plate 91A, an adhesive layer 99 is formed by the application of a transparent adhesive agent in liquid form or by the attachment of a transparent adhesive agent in sheet form. On top of the adhesive layer 99, a plurality of electrically conductive wires 92 are arranged in parallel. Next, on top of the electrically conductive wires 92, a thicker adhesive layer 99 is formed by the application of a transparent adhesive agent in liquid form or by the attachment of a transparent adhesive agent in sheet form. Thereafter, the adhesive layer 99 is allowed to harden. When the adhesive layer 99 has hardened, an electrically insulating transparent material in liquid form is poured (or sprayed) on top of the adhesive layer 99 and allowed to harden, which electrical insulating transparent material forms a transparent plate 91B when it has hardened.

The electrically conductive transparent materials 70 to 90 in the transparent-plate shapes that are constructed as described above have a pair of transparent plates 71 to 91 (substrate unit) made of an electrically insulating transparent material, transparent adhesive layers 79 to 99 that connect the transparent plates 71 to 91, and electrically conductive wires 72 to 92 buried within the adhesive layers 79 to 99. Therefore, by the separation of the transparent plates 71 to 91 from each other in parts, and by the dissolving of the adhesive layers 79 to 99 by use of a solvent, it is possible to expose portions of the electrically conductive wires 72 to 92 to the outside of the bases 71 to 91. The exposed portions of the electrically conductive wires 72 to 92 can be used as terminals for the supply of electricity. As the adhesive layer 79, there can be used adhesive agents that are dissolved by use of solvents such as paint thinner, acetone, xylene, methylethyl ketone, and the like.

Example 10

Figure 44:
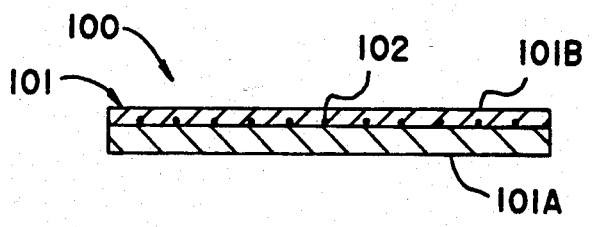
Figure 45:
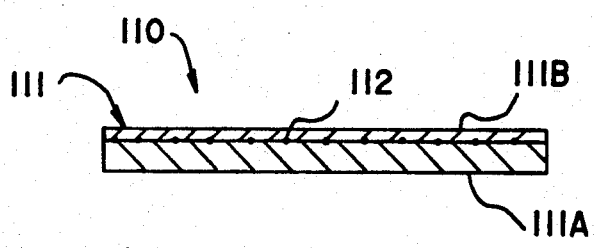
Figure 46:
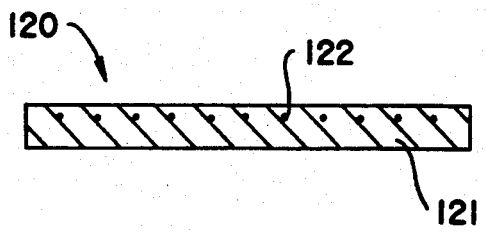

FIGS. 44 to 46 show another different form of Example 7.

The electrically conductive transparent material 100 shown in FIG. 44 is made in the following way. On top of a transparent plate 101A, a plurality of electrically conductive wires 102 are arranged roughly in parallel, and then, on top of the transparent plate 101A and the electrically conductive wires 102, there is formed a transparent plate 101B made by the application or the pouring of an electrically insulating transparent material in liquid form. The electrically conductive transparent material 110 shown in FIG. 45 is made in the following way. On top of a transparent plate 111A, a plurality of electrically conductive wires 112 are arranged roughly in parallel, and then, while this structure is being heated, electrically conductive wires 112 are pressed into the side of the transparent plate 111A with the application of pressure. Because of the melting of the transparent plate 111A, electrically conductive wires 112 is buried in the transparent plate 111A. One portion of the electrically conductive wires 112 is buried in the transparent plate 111A, and on top of this plate, a transparent plate 111B is formed by the application or the pouring of an electrically insulating transparent material in liquid form. Reference numeral 111 in the figure is the base made of transparent plates 111A and 111B.

The electrically conductive transparent material 120 shown in FIG. 46 is formed in one piece, when the base 121 is formed from an electrically insulating transparent material, by the burying of electrically conductive wires 122 in the material used in the formation at the same time.

The electrically conductive transparent materials 100 to 120 constructed as described above have their electrically conductive wires 102 to 122 placed off-center toward one side of the surfaces of the bases 101 to 121, so, as described above, by the dissolving of the substrate units 101 to 121 by use of a solvent, it is possible to expose terminals for the supply of electricity to the surfaces of the substrate units 101 to 121.

I claim:

1. An electrically conductive transparent material comprising:

a substrate unit made of an electrically insulating transparent material; and an electrically conductive transparent unit buried inside said substrate unit, wherein said electrically conductive transparent unit consists of a plurality of electrically conductive wires which are arranged approximately parallel and which do not intersect with each other, and electrically insulating wires which are contained in a network of said plurality of electrically conductive wires.

2. An electrically conductive transparent material according to claim 1, wherein said electrically conductive wires have individual diameters of 0.1 mm or less.

3. An electrically conductive transparent material according to claim 1, wherein said electrically conductive wires and said electrically insulating wires have individual diameters of 0.1 mm or less.

4. An electrically conductive transparent material according to claim 1, wherein the substrate unit is provided with a number of holes for the exposure of transparent conductive portions of the electrically conductive transparent unit.

5. An electrically conductive transparent material according to claim 1, wherein said substrate unit is formed by the attachment of a plurality of constituent substrates together by an adhesive agent, and said electrically conductive transparent unit is arranged in the attached parts of said constituent substrates.

6. An electrically conductive transparent material according to claim 1, wherein said electrically conductive transparent unit is positioned from the central part in the direction of thickness of the substrate unit toward one surface of the substrate unit.

7. A display device comprising an electrically conductive transparent material according to claim 1 and display elements that, respectively, are connected electrically to feeder terminals for a plurality of transparent conductive portions provided for said electrically conductive transparent material.

8. A display device according to claim 7, wherein openings are formed in the substrate unit that is provided for said electrically conductive transparent material, and said display elements are placed in said openings so that the feeder terminals of the display elements are connected electrically with the transparent conductive portions that are exposed on said openings.

9. A display device according to claim 8, wherein a plurality of said display elements are positioned around said openings.

10. A display device according to claim 7, wherein said substrate unit is provided with concave portions for the exposure of said transparent conductive portions, and display elements are placed in said concave portions, so that said display elements are connected electrically with the transparent conductive portions.

11. A display device according to claim 7, wherein a plurality of said display elements are arranged along the outside of said substrate unit, and display elements are connected electrically with the transparent conductive portions that are exposed on the outer edge surface of said substrate unit.

* * * * *